United States Patent [19]

Kizlauskas

[11] 4,261,461

[45] Apr. 14, 1981

[54] SHADOW BOX SHIPPING/DISPLAY CONTAINER

[75] Inventor: George Kizlauskas, Jamaica, N.Y.

[73] Assignee: Mateflex/Mele Corporation, Utica, N.Y.

[21] Appl. No.: 73,856

[22] Filed: Sep. 10, 1979

[51] Int. Cl.[3] ..... B65D 85/40; B65D 81/04; B65D 5/50

[52] U.S. Cl. ..... 206/45.14; 206/45.19; 206/566; 220/8

[58] Field of Search ..... 206/45.31, 45.14, 45.19, 206/306, 0.82, 566; 220/8

[56] References Cited

U.S. PATENT DOCUMENTS

| | | | |
|---|---|---|---|
| 575,621 | 1/1897 | Smith | 220/8 |
| 1,037,551 | 9/1912 | Sharp | 206/0.82 |
| 2,219,212 | 10/1940 | Sundee | 206/45.19 |
| 3,283,894 | 11/1966 | Hafner et al. | 206/306 |
| 3,286,717 | 11/1966 | Teegardin | 206/0.82 |
| 3,941,237 | 3/1976 | MacGregor, Jr. | 206/306 |
| 4,082,183 | 4/1978 | Strum | 206/45.19 |

*Primary Examiner*—William T. Dixson, Jr.
*Attorney, Agent, or Firm*—Kane, Dalsimer, Kane, Sullivan and Kurucz

[57] ABSTRACT

The disclosure is of a combination container for the shipping and display of small articles such as jewelry. In its display condition, the container provides a shadow box.

4 Claims, 10 Drawing Figures

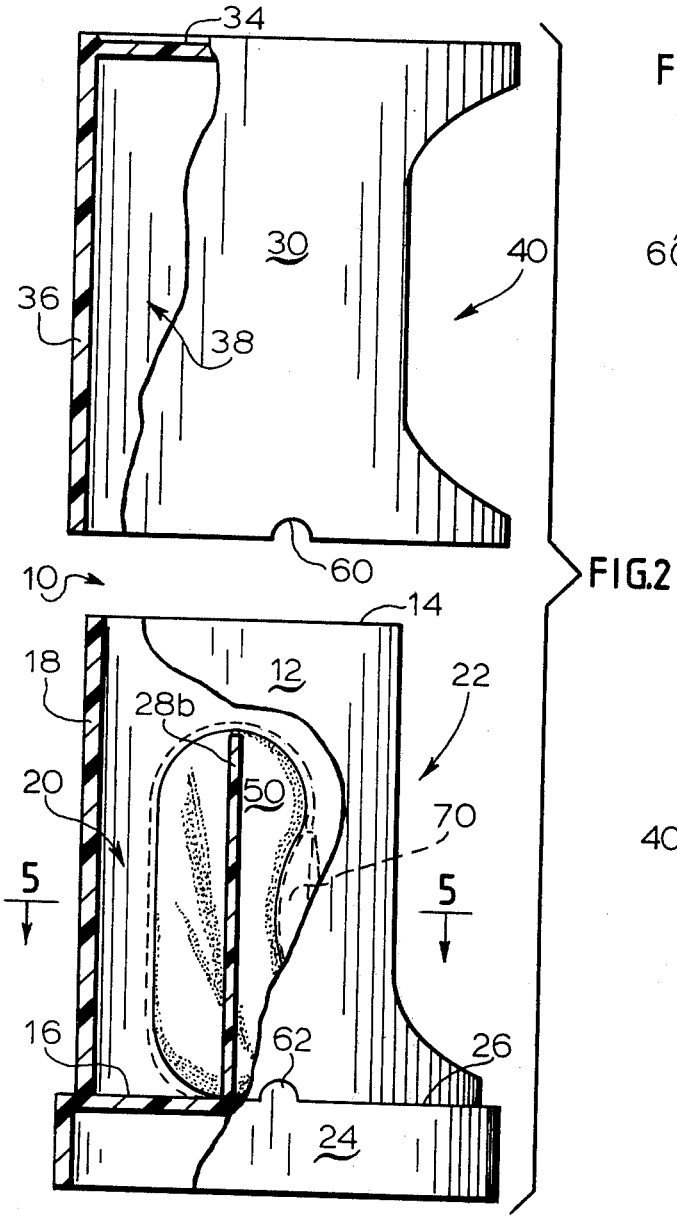
FIG.2
FIG.3
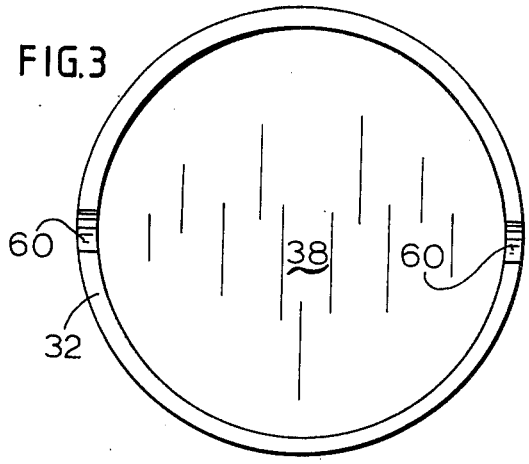
FIG.4
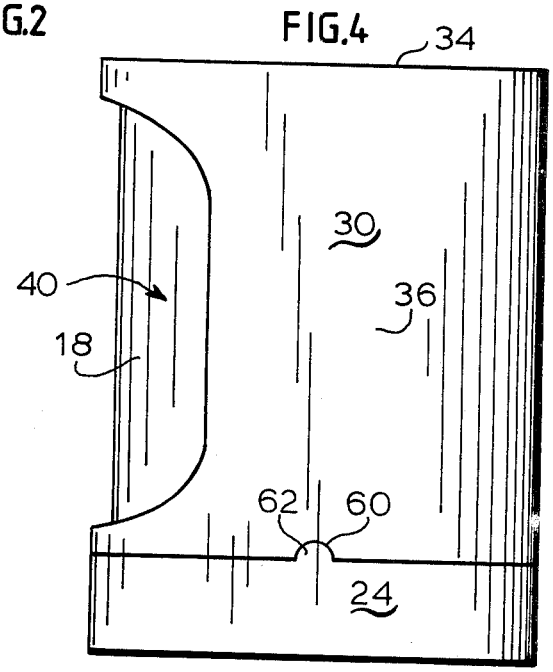
FIG.5
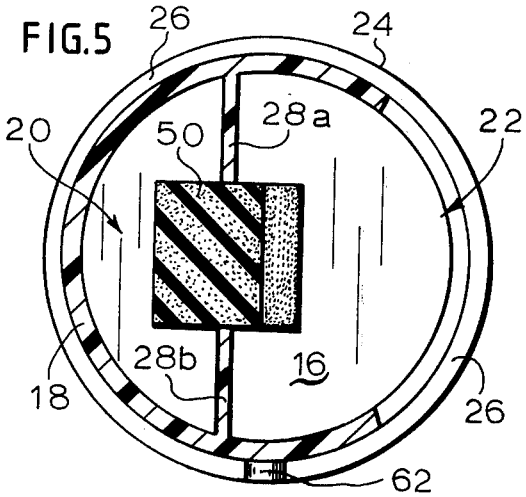
FIG 6
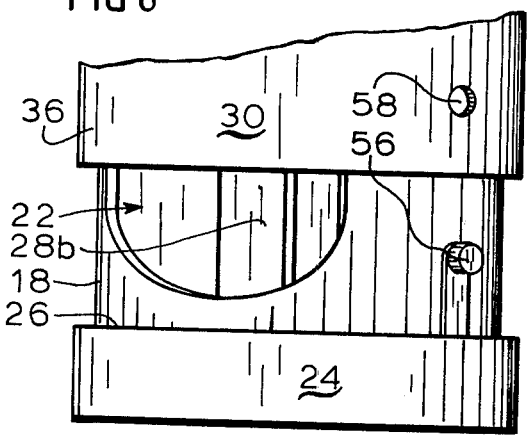

SHADOW BOX SHIPPING/DISPLAY CONTAINER

BACKGROUND OF THE INVENTION

Field of the Invention

The invention relates to containers which are advantageously used to both ship and display their contents and more particularly relates to a shipping container which may be converted to a shadow box type of display case for jewelry and like articles contained therein.

SUMMARY OF THE INVENTION

The invention comprises a shipping container assembly for small articles, which is convertable to a shadow box for displaying a contained article, which comprises;

(i) a tube, which includes (a) an open end;

(b) a closed end;

(c) a wall joining the open and closed ends and having a window therein;

said wall together with the window and the open and closed ends defining a containment chamber which is a shadow-box when viewed through the window; and (d) means within the containment chamber for supporting an article in the window view.

(ii) a sheath, which includes (a) an open end;

(b) a closed end;

(c) a wall joining the open and closed ends of the sheath and having a window therein; and (d) an axial bore defined by the sheath wall and communicating between the ends of the sheath;

said sheath being adapted by size and configuration to sheath the tube (i) within the axial bore;

said tube being rotatably mounted in the axial bore of the sheath in a position wherein the open end of the sheath is closed by the closed end of the tube and the open end of the tube is closed by the closed end of the sheath;

said tube and said sheath being rotatable with respect to each other about a common axis, from a first position where the window of the tube is misaligned with the window of the sheath and the containment chamber is closed from view by the wall of the sheath, to a second position where the window of the tube is aligned with the window of the sheath and the containment chamber is open to view through the aligned windows.

BRIEF DESCRIPTION OF THE DRAWINGS

FIG. 2 is a partially sectioned, side elevation of the embodiment assembly of FIG. 1, shown in partial disassembly.

FIG. 3 is a bottom view of the outer sleeve component of the container assembly shown in FIGS. 1 and 2.

FIG. 4 is a side elevation of the container assembly of FIGS. 1 and 2, shown assembled in the closed condition for shipping a contained article.

FIG. 5 is a cross-sectional view along lines 5—5 of FIG. 2.

FIG. 6 is a view of an alternate locking means for assembly of the container of the invention.

DETAILED DESCRIPTION OF THE PREFERRED EMBODIMENTS OF THE INVENTION

Figure 1:
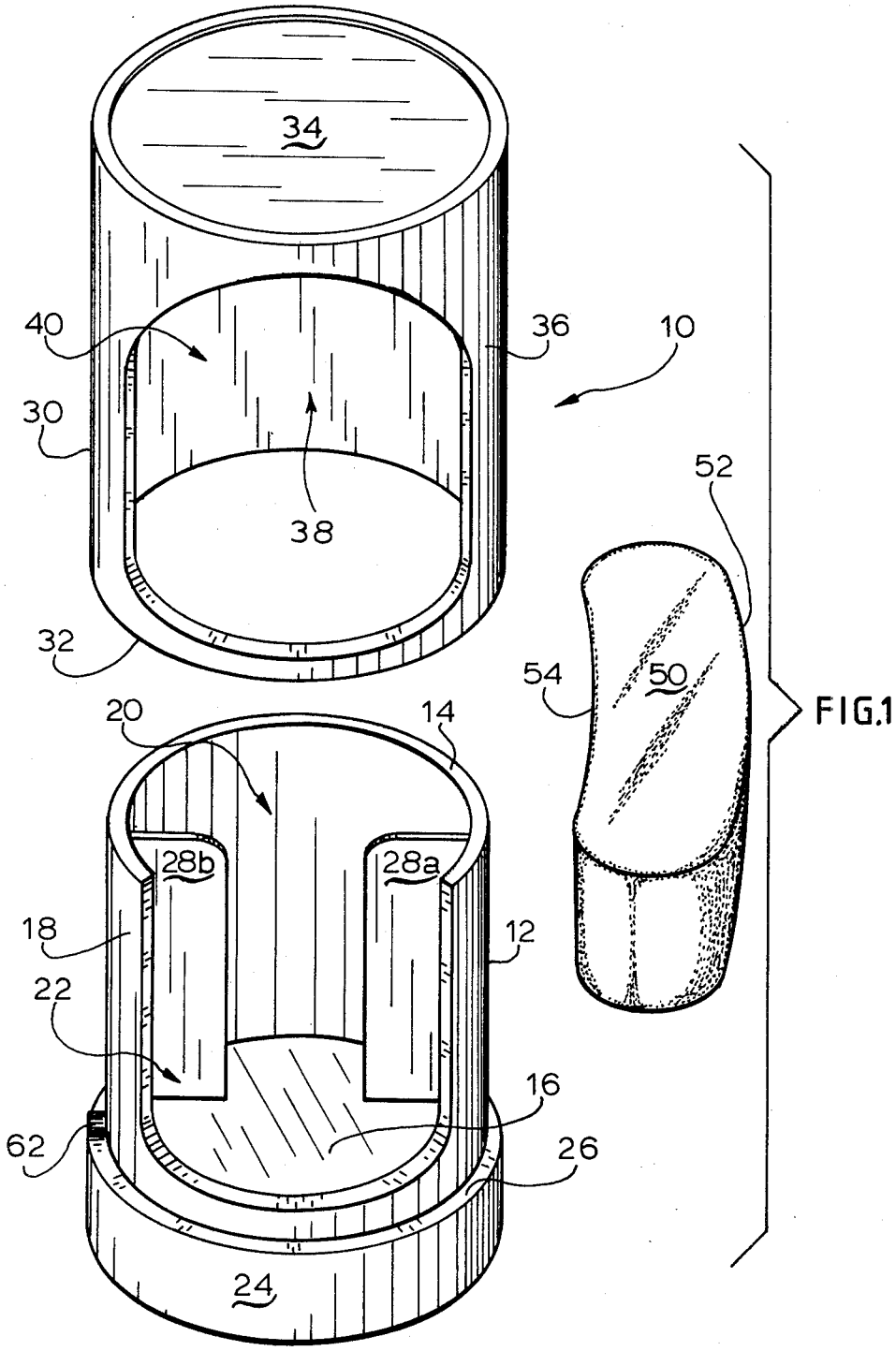
FIG. 1 is a view-in-perspective of a preferred embodiment container assembly of the invention, shown in disassembly.

FIG. 1 is a view-in-perspective of a preferred embodiment container assembly of the invention which is illustrative of the invention. The assembly 10 of the invention is shown in this assembly and comprises three basic components. The first component is a tubular member 12 which may be characterized as having an open end 14 and a closed end 16 with a wall 18 joining ends 14, 16. Cut through the wall 18 is a window 22 through which one may view a containment chamber 20 which is defined by the wall 18 together with ends 14, 16. The containment chamber 20 is, in fact, a "shadow box" when viewed through the window 22. The tube 12 of the preferred embodiment shown in FIG. 1 includes also a pedestal 24 which is a skirt depending from flange 26 extending about the outer periphery of the closed end 16 of tube 12.

A second component of the assembly 10 is found in sheath 30 which is also a tubular member having an open end 32 and a closed end 34. The ends 32,34 are joined by wall 36 which, together with ends 32, 34 define an axial bore 38 communicating between the ends 32, 34. The wall 36 is pierced by a window 40 which permits viewing of the axial bore 38.

The axial bore 38 and the entire structure of sheath 30 is adapted by size and configuration to sheath tube 12 which slips into the axial bore 38 through the open end 32 of sheath 30. In assembly, the tube 12 is rotatably mounted in the axial bore 38 of sheath 30 so that the open end 32 of sheath 30 is closed by the closed end 16 of tube 12 and the open end 14 of tube 12 is closed by the closed end 34 of the sheath 30. The sheath 30 when emplaced to sheath tube 12 is stopped against the flange 26 of tube 12 so that when the two components of tube 12 and sheath 30 are assembled together, the tube 12 and the sheath 30 are rotatable with respect to each other about a common axis, from a first position where the window 22 of tube 12 is misaligned with the window 40 of sheath 30. In this position, the containment chamber 20 is closed from view by the wall 36 of sheath 30. Tube 12 and sheath 30 are rotatable with respect to each other from this first position to a second position where the window 22 of tube 12 is aligned with window 40 of sheath 30 and the containment chamber 20 is open to view through the aligned windows 22, 40.

A third component of the preferred assembly 10 shown in FIG. 1 is found in an elongate body 50 of a flexible, polymeric resin foam adapted to be held by a frictional fit within the containment chamber 20 between supporting bars 28A and 28B which are integrally formed on the interior surface of wall 18. When the article to be shipped and displayed in the assembly 10 is an article such as a wrist watch, the body 50 preferably has an outer convex surface 52 and an inner concave surface 54 as a support means for the article. In any event, body 50 together with support bars 28A and 28B comprise a means within containment chamber 20 for supporting an article in the view of aligned windows 22, 40.

With the exception of the polymeric resin foam body 50, the remaining components of the assembly 10 may be fabricated from any conventional materials employed in the container arts. Preferably employed are polymeric resins such as polyvinylchloride, polyethylene, polypropylene, polycarbonate and like polymeric resins.

FIG. 2 is a partially sectioned, side elevation of the embodiment assembly 10 shown in FIG. 1, but in partial disassembly. Viewing FIG. 2, one may see the foam body 50 positioned in the containment chamber 20, held in a frictional fit between support bars 28A, 28B. Shown in phantom lines is a wrist watch supported on foam body 50 within the containment chamber 20. It will also be observed that the foam body 50 together with the supported article divides containment chamber 20 into an anterior and a posterior subchamber. The posterior subchamber behind the form body 50 and distal to window 22, may be utilized to contain documents or accessories related to the contained article such as the wrist watch. Also shown in FIG. 2 is a notch 60 in the wall 36 at open end 32 of sheath 30. This notch 60 cooperates with a bead 62 on flange 26 to hold or lock sheath 30 in either the first or second positions described above for aligning and misaligning the windows 22, 40. The lock provided by notch 60 and bead 62 is removable by simply withdrawing sheath 30 slightly from its stop against flange 26.

FIG. 3 is a bottom view of the outer sleeve or sheath 30 of the container assembly tube shown in FIGS. 1 and 2 and shows further details of the construction. A second notch 60 is shown 180° removed from the first notch 60.

FIG. 5 is a cross-sectional view along line 5—5 of FIG. 2 and again shows further structural details of the container assembly 10 of the invention.

FIG. 6 is a view of an alternate locking means for maintaining assembly of the sheath 30 over tube 12 and comprises a detent 56 which by a spring like action will secure both vertical and rotational movement of the sheath 30 in respect to tube 12 by engagement in hole 58. The detent 56 may be pressed out of hole 58 when it is desired to unsheath tube 12 or to rotate the sheath 30 or tube 12 in respect of one another.

Figure 7:
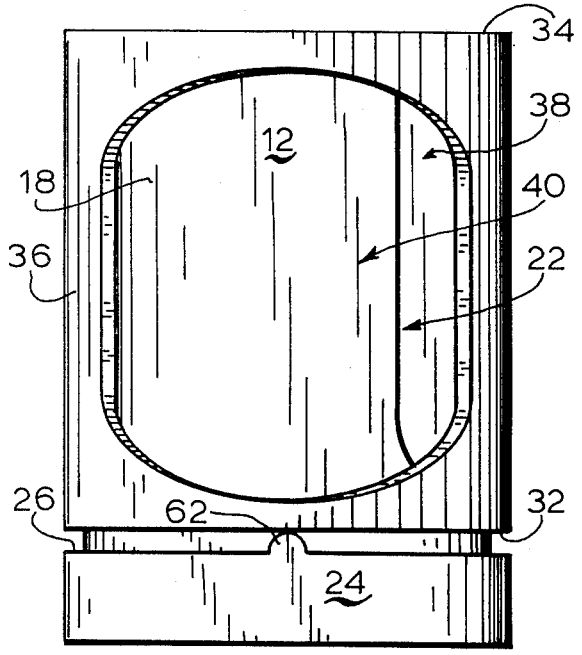
FIG. 7 is a view as in FIG. 5 but with partial conversion of the container to its display condition.
Figure 8:
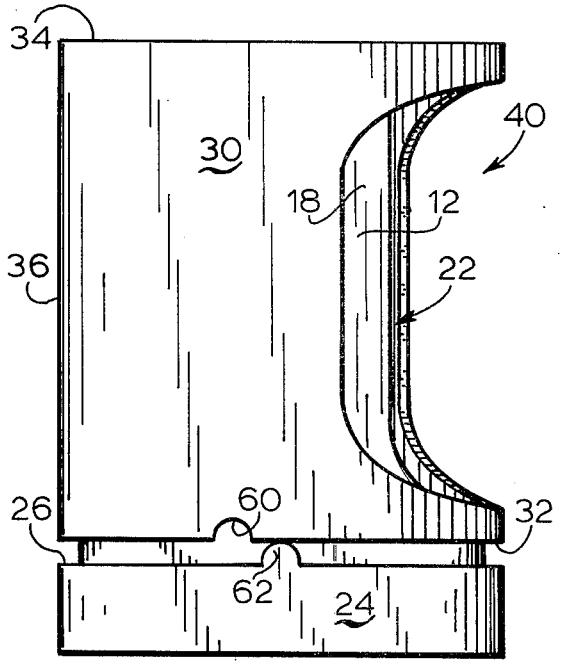
FIG. 8 is a view as in FIG. 7, but with conversion of the container from its shipping condition to its display condition almost complete.
Figure 9:
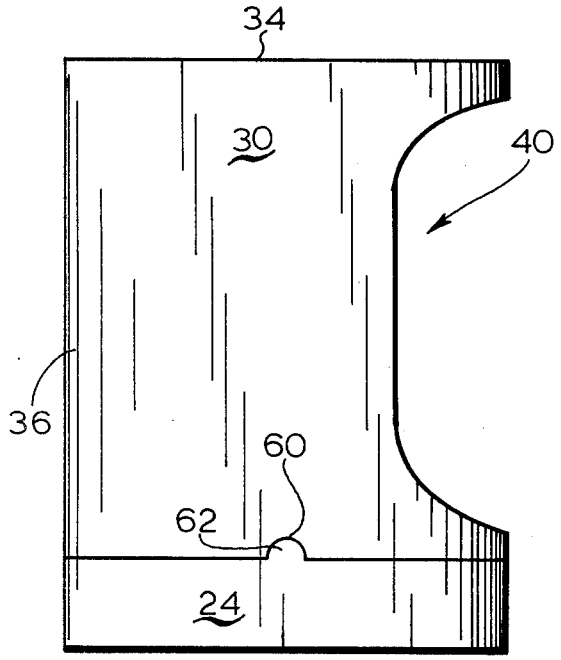
FIG. 9 is a view of the container of the invention as shown in FIG. 5 but in its display condition.

FIG. 4 is a side elevation of the container assembly of FIGS. 1 and 2 shown assembled in the closed condition for shipping a contained article. In other words, the windows 22, 40 are misaligned so that one may not view the containment chamber 20 and any contained articles. In this condition, the assembly 10 may be employed for shipment and/or storage of the contained article. FIG. 7 is a view as in FIG. 5 but with partial conversion of the container assembly 10 to its display condition by a partial withdrawal of sheath 30 from its stop against flange 26 to disengage notch 60 and permit rotation of the tube 12 and sheath 30 in respect to one another. In FIG. 8, rotation of the respective components 30, 12 has nearly achieved a 180° rotation so that the window 22, 40 are nearly in complete alignment. In FIG. 9, 180° rotation of the parts 12, 30 has been achieved and the window 22 is now in full alignment with window 40. The notch 60 has again engaged bead 62 to secure the position of sheath 30 in respect to tube 12.

Figure 10:
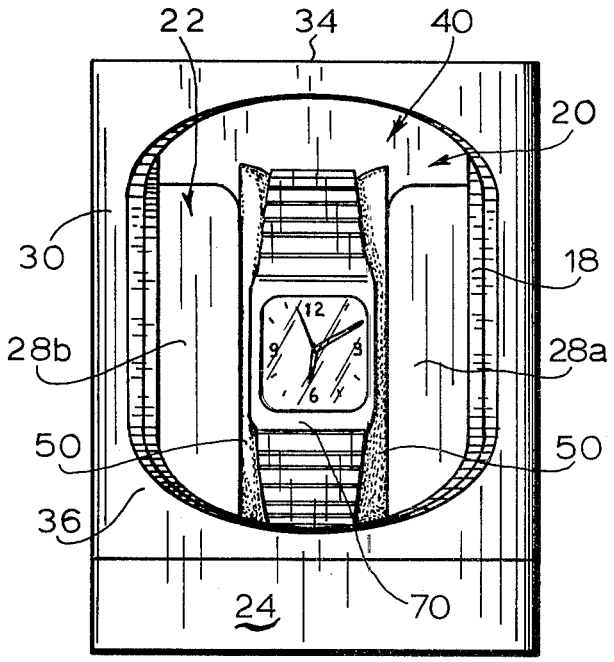
FIG. 10 is a front view of the container shown in FIG. 9, showing a contained article displayed in the shadow box container.

FIG. 10 is a front view of a container shown in FIG. 9 showing the contained article displayed in the shadow box container. The shadow box container assembly 10 of the invention is particularly advantageous for a display of small articles of jewelry such as wrist watch 70 which is completely supported and insulated against shock on the foam body 50.

I claim:

1. A shipping container assembly for small articles, which is convertable to a shadow box for displaying a contained article, which comprises;

(i) a tube, which includes
  (a) an open end;
  (b) a closed end;
  (c) a wall joining the open and closed ends and having a window therein;

said wall together with the window and the open and closed ends defining a containment chamber which is a shadow-box when viewed through the window; and
  (d) means within the containment chamber for supporting an article in the window view, (ii) a sheath, which includes
  (a) an open end;
  (b) a closed end;
  (c) a wall joining the open and closed ends of the sheath and having a window therein; and
  (d) an axial bore defined by the sheath wall and communicating between the ends of the sheath;

said sheath being adapted by size and configuration to sheath the tube (i) within the axial bore;

said tube being rotatably mounted in the axial bore of the sheath in a position wherein the open end of the sheath is closed by the closed end of the tube and the open end of the tube is closed by the closed end of the sheath;

said tube and said sheath being rotatable with respect to each other about a common axis, from a first position where the window of the tube is misaligned with the window of the sheath and the containment chamber is closed from view by the wall of the sheath, to a second position where the window of the tube is aligned with the window of the sheath and the containment chamber is open to view through the aligned windows.

2. The assembly of claim 1, wherein said supporting means comprises a flexible, polymeric resin body held in the containment chamber by a frictional fit with support members which are integrally formed on the inner surface of the wall (i) (c).

3. The assembly of claim 1 wherein there is means for releasably locking said tube and said sheath together in said first and second positions, said means for locking comprising a first component located on the open end of the sheath and a mating, second component located on the closed end of the tube, said first and second components cooperating together to form the releasably locking means.

4. The assembly of claim 3 wherein the first component is a notch and said second component is a bead.

* * * * *